US006390695B1

(12) United States Patent
Buswell

(10) Patent No.: US 6,390,695 B1
(45) Date of Patent: May 21, 2002

(54) IMAGING DEVICE TESTING WITH THERMOGRAPHIC SHEET MATERIAL

(75) Inventor: Ken Buswell, Granite Bay, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/634,263

(22) Filed: Aug. 8, 2000

(51) Int. Cl.[7] ..... G03G 15/00
(52) U.S. Cl. ..... 397/15; 399/33
(58) Field of Search ..... 399/15, 33; 374/104, 374/162; 116/217

(56) References Cited

U.S. PATENT DOCUMENTS 3,817,103 A * 6/1974 Diamond et al. ..... 399/15 X
3,845,662 A * 11/1974 Surgina et al. ..... 116/217
4,601,588 A * 7/1986 Takahara et al. ..... 374/106
4,831,420 A * 5/1989 Walsh et al. ..... 399/16
5,138,390 A * 8/1992 Miyabayashi et al. ..... 355/283
5,619,307 A * 4/1997 Machino et al. ..... 399/11

* cited by examiner

*Primary Examiner*—Quana M. Grainger

(57) ABSTRACT

A heat transfer test assembly is described in the context of an imaging system of a type wherein sheet material is passed through the imaging system and an image is formed on the sheet material, and the imaging system includes a heat transfer stage wherein heat is transferred to sheet material. The test assembly includes at least one test sheet having thermographic properties, the test sheet having dimensions enabling it to be passed through the imaging system. The test assembly also includes a comparison sheet having indicia representing a thermographic sheet that has been passed through an satisfactorily functioning heat transfer stage of an imaging system. Comparison of a test sheet that has been passed through the imaging system with the comparison sheet provides information about the functioning of the imaging system. The indicia on the comparison sheet can be provided as a graphical representation of a thermographic sheet that has been passed through an satisfactorily functioning heat transfer stage, such as a fusing system of a laser imaging system. The thermographic properties of the test sheet can extend across a substantial portion of the width and length of the test sheet. In an embodiment, the thermographic properties of the test sheet extend across the entire width and length of the test sheet. The thermographic properties of the test sheet can be activated at a temperature of approximately 190° C., and may provide a non-reversible and/or multi-colored image. A method of testing heat transfer within an imaging system is also described.

20 Claims, 2 Drawing Sheets

IMAGING DEVICE TESTING WITH THERMOGRAPHIC SHEET MATERIAL

FIELD OF THE INVENTION

The present invention relates to testing image transfer mechanisms of imaging systems. More specifically, the present invention relates to the use of thermographic sheet material to test heat-generating image transfer mechanisms in imaging systems such as printers.

BACKGROUND OF THE INVENTION

Imaging systems such as printers, fax machines, and copiers are virtually omnipresent, and can be found in homes and offices worldwide. The development of such systems has facilitated improvements in communication that have in turn fostered an enormous change in the way people live and work. Telecommuting, paperless offices, and intra-office networks represent but a few examples of the advancements that have been made possible by modern imaging systems.

In imaging systems employing laser or electrophotographic printing, a latent image developed on a charged photoconductive drum or belt is exposed to toner to form a toner image. Then the toner image is transferred from the drum or belt to a print medium, typically sheet material such as paper. After, or concurrent with, the toner image transfer, the process involves the application of heat and pressure to the toner on the print medium, usually by a heated pressure roller backed by an idler roller. This process of heating the toner to secure it to the print medium is called fusing. Thus, the toner is said to be normally fused onto or into the print medium, using one or more heated fuser pressure rollers.

Consistent, high-quality printing requires the fusing system to heat the toner to a toner fusion temperature (e.g., approximately 190° C.), and to do so evenly across the width and length of the print medium. Uneven heating can be caused by factors such as mechanical or electrical failure or toner buildup, and increases the likelihood of degraded print quality.

It can thus be seen that the need exists for a test mechanism to determine evenness of heat transfer in a fusing arrangement of an imaging system.

SUMMARY OF THE INVENTION

The present invention is directed in one embodiment to a heat transfer test assembly in an imaging system of a type wherein sheet material is passed through the imaging system and an image is formed on the sheet material, and the imaging system includes a heat transfer stage wherein heat is transferred to sheet material. The test assembly includes at least one test sheet having thermographic properties. The test assembly also includes a comparison sheet having indicia representing a thermographic sheet that has been passed through an satisfactorily functioning heat transfer stage of an imaging system. Comparison of a test sheet that has been passed through the imaging system with the comparison sheet provides information about the functioning of the imaging system.

The indicia on the comparison sheet can be provided as a graphical representation of a thermographic sheet that has been passed through an satisfactorily functioning heat transfer stage, such as a fusing system of a laser imaging system. The thermographic properties of the test sheet can extend across a substantial portion of the width and length of the test sheet. In an embodiment, the thermographic properties of the test sheet extend across the entire width and length of the test sheet.

The thermographic properties of the test sheet can be activated at a temperature of approximately 190° C., and may provide a non-reversible and/or multicolored image.

A second embodiment of the invention is directed to a method of testing heat transfer within an imaging system. The imaging system is of a type wherein sheet material is passed through the imaging system and an image is formed on the sheet material, with the imaging system including a heat transfer stage wherein heat is transferred to sheet material. In a first step, at least one test sheet having thermographic properties is provided. The test sheet has dimensions enabling it to be passed through the imaging system. A comparison sheet including indicia representing a thermographic sheet that has been passed through an satisfactorily functioning heat transfer stage of an imaging system is provided. The at least one test sheet is passed through the imaging system, and then compared to the comparison sheet to gather information about the functioning of the imaging system.

DETAILED DESCRIPTION OF THE INVENTION

Figure 1:
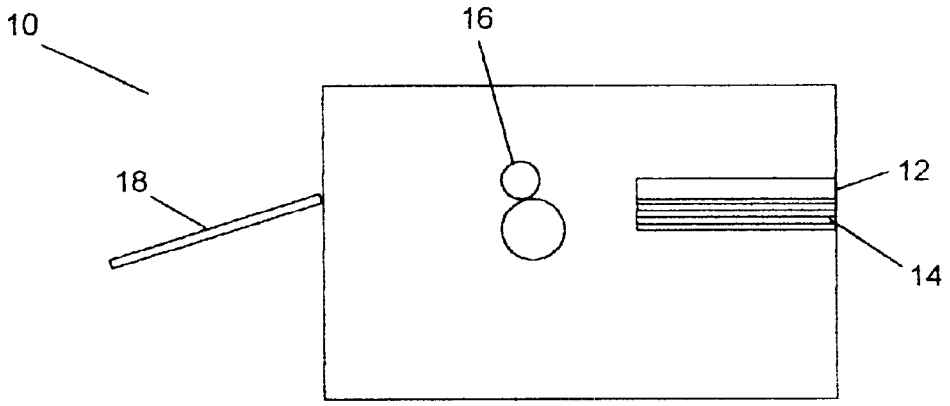
FIG. 1 is a schematic illustration of an imaging system with which the invention might be used.

A typical imaging system 10 with which the present invention might be used is shown in FIG. 1. The imaging system 10 includes a sheet material input 12 adapted to accept sheet material 14. Individual sheets are transported from the input 12 and passed through the system 10. The sheet material passes through a variety of processing stations, including a heat transfer station 16, here shown as a fusing system. After an image has been formed on the sheet material, it exits the system 10 at an output tray 18.

Figure 2:
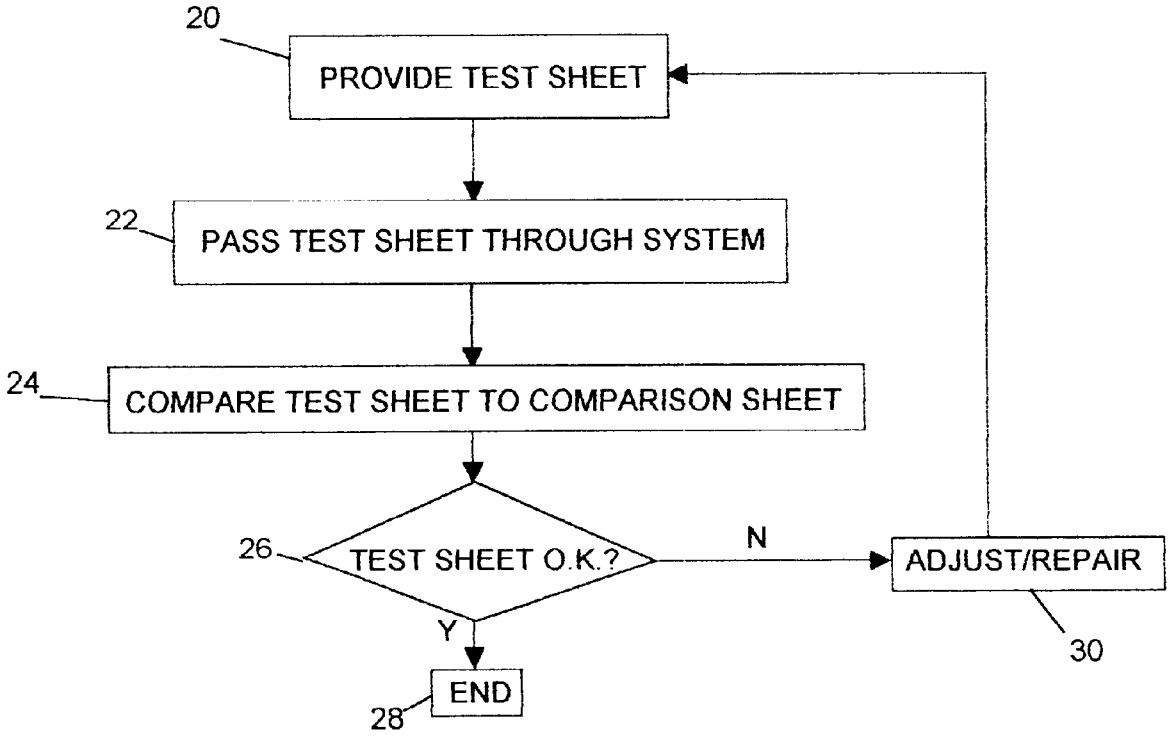
FIG. 2 is a flow chart illustrating a testing method in accordance with the principles of the present invention.

The flow chart of FIG. 2 illustrates an exemplary method of testing heat transfer within an imaging system such as that shown in FIG. 1. At point 20, a test sheet having thermographic properties is provided. The test sheet has dimensions enabling it to be passed through the imaging system. The test sheet can be provided with standard sizes, e.g., U.S. Letter, A4, legal, and 11×17.

One method of providing thermographic properties on the test sheet is to secure a plurality of self-adhesive thermographic indicators onto a sheet of material in locations where heat transfer is critical. Thermographic indicators suitable for this purpose are available from Thermographic Measurement Company, Inc., of Anaheim Hills, Calif. This thermographic sheet material has non-reversible thermographic indicators formulated to change color or value when exposed to a narrow temperature band. The thermographic properties of the test sheet can be composed of several thermographic indicators to cover the operating range of temperatures typically occurring in the imaging system 10. The fusing temperature in a typical laser printer, for example, is about 190°. Hence, the thermographic properties of test sheets used for laser printers are activated at a temperature of about 190°. It is also contemplated that thermographic material providing the desired properties can be printed directly onto sheet material, eliminating the need for individual indicators.

Next, the test sheet is passed through the imaging system at point 22, and then compared to a comparison sheet to gather information about the functioning of the imaging system at point 24. The comparison sheet includes indicia representing a thermographic sheet that has been passed through an satisfactorily functioning heat transfer stage of an imaging system. The comparison sheet can be printed to provide a graphical representation of a "normal" sheet. It is also contemplated that the comparison sheet could also include examples of test sheets indicative of malfunctioning heat transfer systems, and suggest troubleshooting measures.

If the comparison of the test sheet to the comparison sheet indicates a fully functional heat transfer system at point 26, the test ends at point 28. If comparison of the test sheet to the comparison sheet indicates a malfunctioning heat transfer system, appropriate corrective steps are taken at point 30, after which the test reverts to point 20 to be performed again until acceptable results are obtained.

Figure 3:
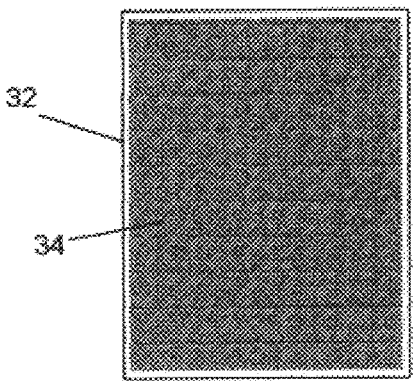
FIG. 3 is a schematic view of a comparison sheet in accordance with the principles of the present invention.

FIG. 3 illustrates one example of a comparison sheet 32. The comparison sheet 32 includes a graphical element 34 representing a thermographic sheet that has been passed through an satisfactorily functioning heat transfer stage of an imaging system. The graphical element 34 extends the entire width and length of the comparison sheet 32, and is uniform in appearance throughout.

Figure 4:
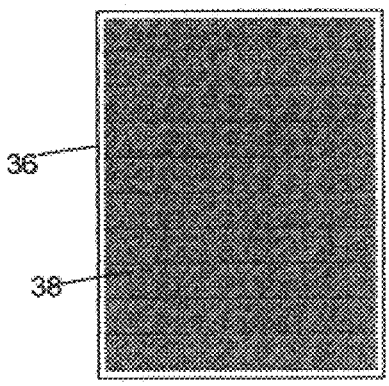
FIGS. 4 through 8 are schematic illustrations of exemplary test sheets.

FIG. 4 illustrates one example of a thermographic test sheet 36 that has been passed through an satisfactorily functioning heat transfer stage of an imaging system. The thermographic properties of the test sheet 36 extend the entire width and length of the test sheet 36, and after actuation produce an image 38 that is uniform in appearance throughout.

Figure 5:
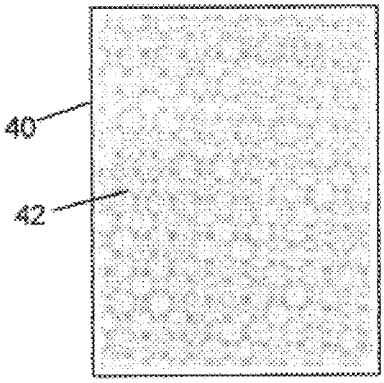

FIG. 5 illustrates one example of a thermographic test sheet 40 that has been passed through a malfunctioning heat transfer stage of an imaging system. The thermographic properties of the test sheet 40 extend the entire width and length of the test sheet 40, and after actuation produce an image 42 that is uniform in appearance throughout, but lighter and/or of a different color than the graphical element 34 of the comparison sheet 32. This indicates that the heat transfer system, while uniform, is not generating an satisfactory amount of heat.

Figure 6:
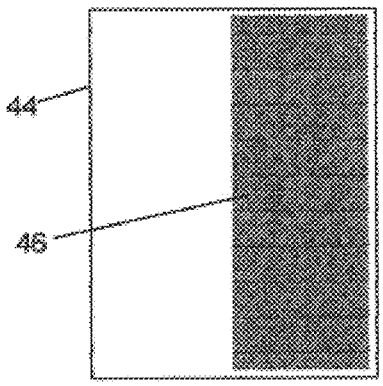

FIG. 6 illustrates another example of a thermographic test sheet 44 that has been passed through a malfunctioning heat transfer stage of an imaging system. The thermographic properties of the test sheet 44 extend the entire width and length of the test sheet 44, but after actuation produce an image 46 that is on only one side of the test sheet 44. This indicates that the heat transfer system is not generating heat uniformly along its width.

Figure 7:
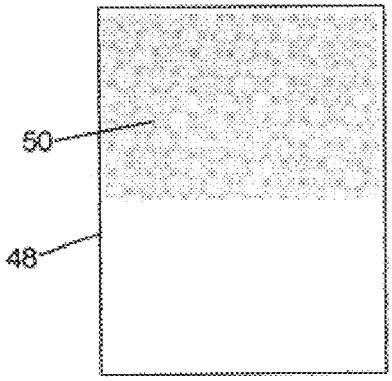

FIG. 7 illustrates another example of a thermographic test sheet 48 that has been passed through a malfunctioning heat transfer stage of an imaging system. The thermographic properties of the test sheet 44 extend the entire width and length of the test sheet 48, but after actuation produce an image 50 that fades along the length of the test sheet 48. This indicates that the heat transfer system is not generating heat uniformly during the time it takes the test sheet 48 to pass through the heat transfer stage.

Figure 8:
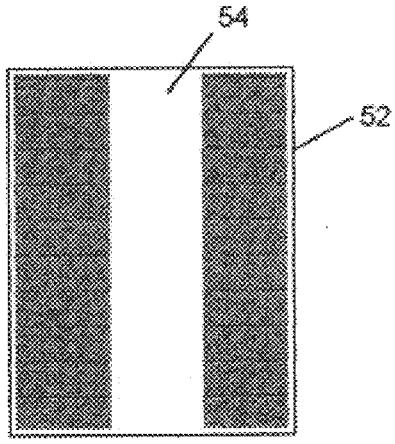

FIG. 8 illustrates another example of a thermographic test sheet 52 that has been passed through a malfunctioning heat transfer stage of an imaging system. The thermographic properties of the test sheet 52 extend the entire width and length of the test sheet 52, but after actuation produce an image that leaves a gap 54 on the center of the test sheet 52. This indicates that the heat transfer system is not generating heat uniformly along its width.

Of course, other results, or combinations of the illustrated results, may also be recorded and observed using the testing assembly and method of the present invention. The present invention is suited for use with any imaging system having a heat transfer stage, and finds particular utility in conjunction with a laser printer. Thermal indicators positioned across the width and length of the test sheet detect "hot/cold" temperature variations across the width of the fusing roller, and along the length of the sheet to indicate high/low temperature regulation during heat cycling of the fuser roller. When the test sheet is passed trough the printer and exposed to the printer's fusing system, permanent color or value changes occur to the thermal indicators, thus recording the history of the print cycle.

Although the present invention has been described with reference to specific embodiments, those of skill in the art will recognize that changes may be made thereto without departing from the scope and spirit of the invention as defined by the appended claims.

What is claimed is:

1. In an imaging system wherein sheet material is passed through the imaging system and an image is formed on the sheet material, the imaging system including a heat transfer stage wherein heat is transferred to sheet material, a heat transfer test assembly comprising the following:

at least one test sheet having thermographic properties, the test sheet having dimensions enabling it to be passed through the imaging system; and a comparison sheet including indicia representing a thermographic sheet that has been passed through a satisfactorily functioning heat transfer stage of an imaging system, wherein comparison of a test sheet that has been passed through the imaging system with the comparison sheet providing information about the functioning of the heat transfer stage of the imaging system.

2. A heat transfer test assembly in accordance with claim 1, wherein the indicia on the comparison sheet comprises a graphical representation.

3. A heat transfer test assembly in accordance with claim 1, wherein the heat transfer stage of the imaging system is a fusing system.

4. A heat transfer test assembly in accordance with claim 3, wherein the imaging system is a laser imaging system.

5. A heat transfer test assembly in accordance with claim 1, wherein the test sheet has a width, and the thermographic properties of the test sheet extend across a substantial portion of the width of the test sheet.

6. A heat transfer test assembly in accordance with claim 5, wherein the thermographic properties of the test sheet extend across the entire width of the test sheet.

7. A heat transfer test assembly in accordance with claim 1, wherein the test sheet has a length, and the thermographic properties of the test sheet extend across a substantial portion of the length of the test sheet.

8. A heat transfer test assembly in accordance with claim 7, wherein the thermographic properties of the test sheet extend across the entire length of the test sheet.

9. A heat transfer test assembly in accordance with claim 1, wherein the thermographic properties of the test sheet are activated at a temperature of approximately 190° C.

10. A heat transfer test assembly in accordance with claim 1, wherein the thermographic properties of the test sheet are non-reversibly activated at a temperature of approximately 190° C.

11. In an imaging system wherein sheet material is passed through the imaging system and an image is formed on the sheet material, the imaging system including a heat transfer stage wherein heat is transferred to sheet material, a method of testing heat transfer within the imaging system, the method comprising the following steps:

providing at least one test sheet having thermographic properties, the test sheet having dimensions enabling it to be passed through the imaging system; and providing a comparison sheet including indicia representing a thermographic sheet that has been passed through a an satisfactorily functioning heat transfer stage of an imaging system;

passing the at least one test sheet through the imaging system; and comparing the at least one test sheet, after it has been passed through the imaging system, with the comparison sheet to gather information about the functioning of the heat transfer stage of the imaging system.

12. A method in accordance with claim 11, wherein the step of providing a comparison sheet including indicia comprises providing a comparison sheet including a graphical representation of a thermographic sheet that has been passed through an satisfactorily functioning heat transfer stage of an imaging system.

13. A method in accordance with claim 11, wherein the step of passing the at least one test sheet through the imaging system comprises passing the at least one test sheet through a fusing system of the imaging system.

14. A method in accordance with claim 11, wherein the step of providing at least one test sheet having thermographic properties comprises providing a test sheet having a width, with the thermographic properties of the test sheet extending across a substantial portion of the width of the test sheet.

15. A method in accordance with claim 14, wherein the step of providing at least one test sheet having thermographic properties comprises providing a test sheet wherein the thermographic properties of the test sheet extend across the entire width of the test sheet.

16. A method in accordance with claim 11, wherein the step of providing at least one test sheet having thermographic properties comprises providing a test sheet having a length, with the thermographic properties of the test sheet extending across a substantial portion of the length of the test sheet.

17. A method in accordance with claim 16, wherein the step of providing at least one test sheet having thermographic properties comprises providing a test sheet wherein the thermographic properties of the test sheet extend across the entire length of the test sheet.

18. A method in accordance with claim 11, wherein the step of providing at least one test sheet having thermographic properties comprises providing a test sheet wherein the thermographic properties of the test sheet are activated at a temperature of approximately 190° C.

19. A method in accordance with claim 11, wherein the step of providing at least one test sheet having thermographic properties comprises providing a test sheet wherein the thermographic properties of the test sheet are non-reversibly activated at a temperature of approximately 190° C.

20. A method in accordance with claim 11, wherein the step of providing at least one test sheet having thermographic properties comprises providing a test sheet wherein the thermographic properties of the test sheet are non-reversibly activated at a temperature of approximately 190° C. to produce a multicolor image on the test sheet.

* * * * *

UNITED STATES PATENT AND TRADEMARK OFFICE

CERTIFICATE OF CORRECTION

PATENT NO. : 6,390,695 B1
DATED : May 21, 2002
INVENTOR(S) : Ken Buswell

It is certified that error appears in the above-identified patent and that said Letters Patent is hereby corrected as shown below:

Column 5,
Line 12, after “a” delete “an”

Signed and Sealed this

Seventh Day of September, 2004

JON W. DUDAS
*Director of the United States Patent and Trademark Office*